US006863602B2

(12) United States Patent
Incera

(10) Patent No.: US 6,863,602 B2
(45) Date of Patent: Mar. 8, 2005

(54) METHOD AND APPARATUS FOR BLOCKING AND DEBLOCKING A LENS

(75) Inventor: Alex Incera, Pomfret, CT (US)

(73) Assignee: Gerber Coburn Optical, Inc., South Windsor, CT (US)

( * ) Notice: Subject to any disclaimer, the term of this patent is extended or adjusted under 35 U.S.C. 154(b) by 24 days.

(21) Appl. No.: 10/310,117

(22) Filed: Dec. 4, 2002

(65) Prior Publication Data

US 2004/0110454 A1 Jun. 10, 2004

(51) Int. Cl.[7] ..... B24B 41/06
(52) U.S. Cl. ..... 451/384; 451/42; 451/53
(58) Field of Search ..... 451/384, 390, 451/7, 42, 43, 53, 240, 255, 256, 277, 323, 325, 495, 504

(56) References Cited

U.S. PATENT DOCUMENTS 3,383,808 A * 5/1968 Deshayes et al. ..... 451/390
5,380,387 A * 1/1995 Salamon et al. ..... 156/154
5,421,771 A * 6/1995 Wardle ..... 451/390
5,695,393 A * 12/1997 Granziera ..... 451/390
5,792,537 A * 8/1998 Ohlin, Jr. ..... 428/45
6,012,965 A * 1/2000 Savoie ..... 451/6
6,036,313 A * 3/2000 Benjamin et al. ..... 351/159
6,110,016 A * 8/2000 Coleman et al. ..... 451/42
6,126,528 A * 10/2000 Sedlock ..... 451/390
6,586,499 B2 * 7/2003 Bonafini et al. ..... 523/168

* cited by examiner

*Primary Examiner*—David B. Thomas
(74) *Attorney, Agent, or Firm*—McCormick, Paulding & Huber LLP

(57) ABSTRACT

Disclosed herein is a block including a block base configured to support a lens for surfacing or finishing, a cover retained to the base, and a formable material disposed between the base and the cover. Further disclosed herein is a system for blocking a lens including a block base configured to support a lens for processing, a cover retained to the base, a formable material disposed between the base and the cover, and a receptacle configured to receive the base to heat and cool the base. Further disclosed herein is a method for blocking a lens includes heating a block to render the formable material pliable, applying a lens to the block, and cooling the block to render the material non-pliable. A method for blocking a lens includes rendering a formable material of a block pliable, deforming the material with a lens, rendering the formable material non-pliable and causing a vacuum between the formable material and the lens to hold the lens to the block. A method for deblocking a lens includes heating a formable material of a block and removing the lens from the block.

44 Claims, 1 Drawing Sheet

METHOD AND APPARATUS FOR BLOCKING AND DEBLOCKING A LENS

BACKGROUND

Prescriptive lenses are ubiquitous in populations all over the world to enhance the visual acuity of the people making up those populations. People each have individual needs and desires with regard to optical properties and aesthetic appearance of their eyewear. Because of this, lenses are nearly continuously ground polished and fined at millions of eye centers worldwide. In an age of immediate gratification, the ability of providers to finish such lenses rapidly is important to many.

Speeding lens manufacture requires speeding individual steps in the manufacturing process. Blocking whether it be for surfacing operations or finishing operations is one step that increases overall time in the manufacture of lenses at least because of the need to clean the lens of the adhesion material used in blocking or taping the lens. Such cleaning occurs once the lens is separated from the block. Different blocking materials such as alloy metals or waxes or tape require different cleaning methods, but each takes time.

Another drawback common in the part art is shock stress on a lens caused by a deblocking operation. The apparatus and method disclosed hereinafter alleviates shock stress as well by providing a quick, easy and effective means of deblocking the lens without the banging currently common in the art. In the continuing effort to reduce time associated with ophthalmic lens production and the quest to produce better lenses, the following has been developed.

SUMMARY

Disclosed herein is a block including a block base configured to support a lens for surfacing or finishing, a cover retained to the base, and a formable material disposed between the base and the cover.

Further disclosed herein is a system for blocking a lens including a block base configured to support a lens for processing, a cover retained to the base, a formable material disposed between the base and the cover, and a receptacle configured to receive the base to heat and cool the base.

Further disclosed herein is a method for blocking a lens includes heating a block to render the formable material pliable, applying a lens to the block, and cooling the block to render the material non-pliable.

A method for blocking a lens includes rendering a formable material of a block pliable, deforming the material with a lens, rendering the formable material non-pliable and causing a vacuum between the formable material and the lens to hold the lens to the block.

A method for deblocking a lens includes heating a formable material of a block and removing the lens from the block.

BRIEF DESCRIPTION OF THE DRAWINGS

Referring now to the drawings wherein like elements are numbered alike in the several Figures.

DETAILED DESCRIPTION

A method and apparatus are described herein that effectively secure a lens to a block, reliably and accurately while avoiding prior art adhering compounds such as alloy or wax or tape that must be cleaned off the processed lens at not inconsiderable effort and time as well as avoid the transfer of heat to the lens as is common in the prior art. The method and apparatus hereof obviate the old practice of taping the lens prior to alloy blocking.

Figure 1:
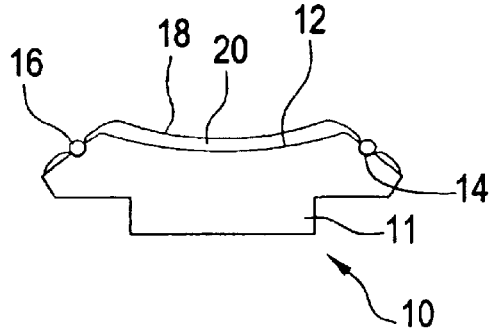
FIG. 1 is a cross-sectional representation of a block.

Referring to FIG. 1, a block 10 is illustrated in one possible configuration thereof. Block base 11, in one embodiment, is constructed of a highly thermally conductive material such as aluminum to facilitate a rapid temperature change at surface 12 (at formable material) thereof for reasons which will become apparent hereunder. The illustrated embodiment of block 10 includes block base 11 having a recess 14 which may be annular, to anchor a hold down member 16 adapted to retain a pliable cover 18 which may be a thermoplastic and may be a vinyl material. The hold down member may be an elastic member and in one embodiment is an o-ring.

In a space defined by cover 18 and surface 12 is placed a formable material 20 which may be polymeric, a wax based substance or otherwise provided it can be brought to a pliable condition (which includes a molten condition or a liquid condition) and a non-pliable condition (which includes a solid condition) with relative ease.

In one embodiment the material is a low melting point thermoplastic paraffin based material and is in a solid form until a temperature of about 115° where it transitions to a pliable form which may be a liquid phase at a temperature range of about 117° to about 120° and is completely in the liquid phase at temperatures above about 121°. It is important to recognize that the temperature ranges provided represent but one possible embodiment. One of skill in the art will undoubtedly be aware of other materials that may be useful in conjunction with the method and apparatus described herein. The temperature ranges for phase change of these materials may be higher or lower and may constitute smaller or larger ranges where affected by temperature sensitivity of a lens to be blocked and/or coatings on such lens as well as temperature tolerability of other components of the system. The cover 18 is in one embodiment, unaffected by heat until a temperature significantly above the temperature at which material 20 is in a liquid phase. As a general rule it is desirable that cover 18 undergo no structural change at temperatures sufficient to produce a completely liquid phase of material 20. Due to the relatively small magnitude of temperature change necessary to transition material 20 (in this embodiment) from solid to liquid phase, use of the device is convenient. It is important to note that as used and claimed herein, the terms formable material may be with or without cover 18 unless otherwise specifically stated or claimed.

Figure 2:
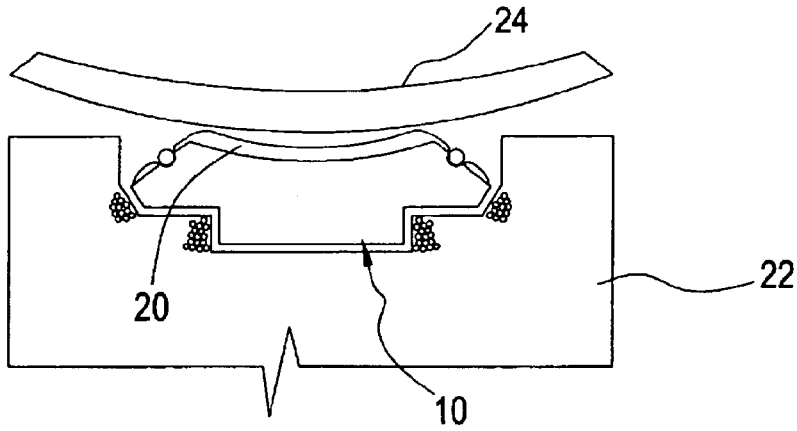
FIG. 2 is a cross-sectional representation of a block engaged in a heating/cooling unit and with a lens thereon.

In one embodiment, referring to FIG. 2, block 10 is heated or cooled conductively. The figure schematically illustrates a receptacle 22 structure in which block 10 may be received. Receptacle 22 can be a part of any desired device as an ancillary portion thereof or could reside in a stand-alone device created for that purpose. Through receptacle 22, block 10 is heatable by direct application of hot fluids ("hot" being defired as of a temperature sufficient to render the formable material pliable) to the block or by inductively heating the block base or conductively heating the block base using coils, resistance wiring (in the receptacle or in the block), p-n junctions (in the receptacle or in the block), etc.

23. Material 20 may also be directly inductively heated or radiantly heated using infra red wavelengths or other wavelengths as desired or required or by application of hot fluids directly to material 20. The heating capability need merely reach the pliability temperature or liquification temperature (depending upon the particular embodiment) of material 20 to be sufficient. Concurrently, receptacle 22 will possess a cooling arrangement. The cooling arrangement need cool the block sufficiently to return material 20 to a non-pliable or even a solid phase. Block 10 is coolable by direct application of a cold fluid ("cold" being defined as of a temperature sufficient to render the formable material non-pliable) to the block base or by conductively cooling the block base using coils (in the receptacle or in the block), p-n junctions (in the receptacle or in the block), etc. Material 20 is also coolable by direct application of such a cold fluid to material 20.

Figure 3:
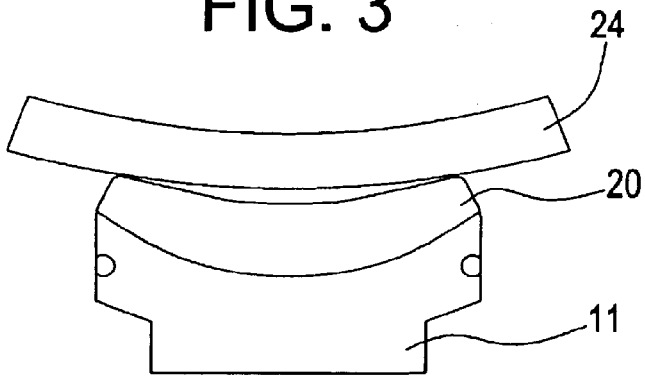
FIG. 3 is an alternate embodiment of a block with a concavity greater than the lens.

Upon heating, still referring to FIG. 2, material 20 becomes pliable and is reformed by lens 24 through a compression process. The applied compression of material 20 through lens 24 is sufficient to cause material 20 to conform to lens 24. In another embodiment block base 11 is more concave than lens 24 to promote greater thermal contraction toward the center of the block vacuum (see FIG. 3). Caution is advised not to create so much vacuum that the lens 24 is distorted thereby. Once the compression/reforming process is complete, which will desirably take merely a moment, a static load is maintained upon the lens 24 or block 10 until the cooling arrangement is cycled and the material 20 is again non-pliable. In the non-pliable condition subsequent to reforming, the lens 24 is held to cover 18 (or to the formable material 20 directly in the event a material is workable for this process without needing a cover material). The holding is caused by the vacuum created between the lens 24 and the cover 18 which occurs naturally upon cooling and slight contraction of the material 20. It is desirable to cause cover 18 to match the contour of lens 24 as closely as possible to minimize air space between lens 24 and cover 18. Once held, lens 24 is securely retained to block 10 and may be processed.

After processes which require blocking of the lens are completed, lens 24 is deblocked from block 10 simply by reheating material 20 and removing lens 24. Heating is accomplished similarly to the methods discussed hereinabove. It will be appreciated that the lens 24 may also be knocked off the block if the particular lens is resistant to potential damage created by the shock induced by knocking the lens off the block.

The method for blocking a lens according to this teaching comprises causing a material disposed upon, or comprising, a block base to become pliable by means of heating the material. Once the material is pliable a lens 24 is urged into contact with block 10 deforming the material 20 and if covered, the cover 18. While rendering the material non-pliable by cooling the same. Lens 24 is held to the deformed material 20/cover 18. By so doing, and as stated above, the artisan is forming a vacuum between the lens and the material 20 or cover 18, depending upon embodiment.

While preferred embodiments of the invention have been shown and described, various modifications and substitutions may be made thereto without departing from the spirit and scope of the invention. Accordingly, it is to be understood that the present invention has been described by way of illustration and not limitation.

What is claimed:

1. A block, comprising:

a block base configured to support a lens for surfacing or finishing;

a cover retained to said base; and a formable material disposed between said base and said cover in a closed cavity that prevents the transfer of formable material into or out of the cavity once the cover is retained to the block base.

2. A block as claimed in claim 1 wherein said material is directly heatable.

3. A block as claimed in claim 1 wherein said block base is thermally conductive.

4. A block as claimed in claim 1 wherein said block base carries a heating/cooling arrangement.

5. A block as claimed in claim 4 wherein said heating arrangement is a resistor.

6. A block as claimed in claim 4 wherein said heating arrangement is a p-n junction.

7. A block as claimed in claim 4 wherein said heating arrangement is an adaptation to receive a fluid capable of rendering said formable material pliable.

8. A block as claimed in claim 7 wherein said fluid is a liquid.

9. A block as claimed in claim 1 wherein said block is heatable by radiation.

10. A block as claimed in claim 1 wherein said material is heatable by radiation.

11. A block as claimed in claim 4 wherein said cooling arrangement is a p-n junction.

12. A block as claimed in claim 4 wherein said cooling arrangement is an adaptation to receive a fluid capable of rendering said formable material non-pliable.

13. A block as claimed in claim 12 wherein said fluid is a liquid.

14. A block as claimed in claim 1 wherein said cover comprises a plastic material.

15. A block as claimed in claim 14 wherein said plastic is a thermoplastic.

16. A block as claimed in claim 14 wherein said plastic is a vinyl.

17. A block as claimed in claim 1 wherein said formable material is transitionable from a solid phase to a liquid phase at a temperature below a temperature at which any structural change occurs to said cover.

18. A block as claimed in claim 1 wherein said formable material is transitionable between a solid phase and a liquid phase above a temperature range of about 115.

19. A block as claimed in claim 1 wherein said formable material is a low melt thermoplastic material.

20. A system for blocking a lens comprising:

a block base configured to support a lens for processing;

a cover retained to said base;

a formable material disposed between said base and said cover in a closed cavity that prevents the transfer of formable material into or out of the cavity once the cover is retained to the block base; and a receptacle configured to receive said base to heat and cool said base.

21. A system for blocking a lens as claimed in claim 20 wherein said receptacle includes a heating arrangement.

22. A system for blocking a lens as claimed in claim 20 wherein said receptacle includes a cooling arrangement.

23. A system for blocking a lens as claimed in claim 21 wherein said heating arrangement is a resistor.

24. A system for blocking a lens as claimed in claim 21 wherein said heating arrangement is a p-n junction.

25. A system for blocking a lens as claimed in claim 21 wherein said heating arrangement is a provision of a fluid capable of rendering said formable material pliable.

26. A system for blocking a lens as claimed in claim 22 wherein said cooling arrangement is a p-n junction.

27. A system for blocking a lens as claimed in claim 22 wherein said cooling arrangement is a provision of a fluid capable of rendering said formabl material non-pliable.

28. A method for blocking a lens comprising:

providing a block having a base configured to support a lens for surfacing or finishing, a cover retained to the base, and a formable material disposed between the base and the cover in a closed cavity that prevents the transfer of formable material into or out of the cavity once the cover is retained to the block base;

heating the block to render the formable material pliable;

applying a lens to said block; and cooling said block to render said material non-pliable.

29. A method for blocking a lens as claimed in claim 28 wherein said heating is to a temperature sufficient to render said material pliable and insufficient to create a structural change in said cover.

30. A method for blocking a lens as claimed in claim 28 wherein said heating is to a temperature sufficient to phase change said material to a liquid.

31. A method for blocking a lens as claimed in claim 28 wherein said applying includes urging said lens against said cover covering said formable material.

32. A method for blocking a lens as claimed in claim 28 wherein said cooling is to a temperature sufficient to phase change said material to a solid.

33. A method for blocking a lens as claimed in claim 28 wherein said A method for blocking a lens as claimed in claim 28 wherein said method further comprises deblocking said lens.

34. A method for blocking a lens as claimed in claim 33 wherein said deblocking includes:

reheating said formable material so render said material pliable; and removing said lens from said block.

35. A method for blocking a lens comprising:

providing a block having a formable material;

rendering the formable material pliable;

deforming said material with a lens;

rendering said formable material non-pliable; and causing vacuum between the formable material and the lens to hold the lens to the block.

36. A method for blocking a lens as claimed in claim 35 wherein said rendering said formable material non-pliable compresses heating.

37. A method for blocking a lens as claimed in claim 35 wherein said rendering said formable material non-pliable comprises cooling.

38. A method for blocking a lens as claimed in claim 37 wherein said cooling is by direct application of a cold fluid to the material, by direct application of a cold fluid to the block base, by conductively cooling the block base by using coils, p-n junctions, and combinations including at least one of the foregoing.

39. A method for blocking a lens as claimed in claim 36 wherein said heating is by direct application of a hot fluid to the material, by direct application of a hot fluid to the block base, by conductively or inductively heating the block base by using coils, resistance wiring, p-n junctions, arid combinations including at least one of the foregoing.

40. A method for blocking a lens as claimed in claim 35 wherein said causing a vacuum is by thermal contraction of the formable material.

41. A method for deblocking a lens comprising:

heating a formable material of a block; and removing said lens from said block.

42. A method for deblocking a lens claimed in claim 41 wherein said heating is to cause sufficient thermal expansion of the formable material to reduce a vacuum between the lens and the formable material.

43. A block, comprising:

a block base configured to support a lens for surfacing or finishing;

a cover retained to said base; and a formable material disposed between said base and said cover, said formable material being selectively changeable between a pliable condition and a non-pliable condition;

wherein in a change between the pliable condition and the non-pliable condition, the formable material is operable to create a vacuum force that attaches the lens to the block.

44. An apparatus for blocking a lens, comprising:

a block having a base configured to support a lens for processing, a cover retained to the base, and a formable material disposed between the base and the cover, the formable material being selectively changeable between a pliable condition and a non-pliable condition;

wherein in a change between the pliable condition and the non-pliable condition, the formable material is operable to create a vacuum force that attaches the lens to the block, and in a change between the non-pliable condition and the pliable condition, the formable material is operable to reduce the vacuum force that attaches the lens to the block.

* * * * *